United States Patent [19]

Hirota et al.

[11] 3,950,194

[45] Apr. 13, 1976

[54] PERMANENT MAGNET MATERIALS

[75] Inventors: Hozumi Hirota, Yamato-koriyama; Yoshio Tawara, Shifyonawate, both of Japan

[73] Assignee: Matsushita Electrical Industrial Co., Ltd., Kadoma, Japan

[22] Filed: July 17, 1974

[21] Appl. No.: 489,837

[30] Foreign Application Priority Data

July 20, 1973 Japan ..... 48-81808

[52] U.S. Cl. ..... 148/31.57; 148/100; 148/103; 75/152

[51] Int. Cl.[2] ..... H01F 1/04

[58] Field of Search ..... 148/31.57, 100, 101, 103; 75/152

[56] References Cited

UNITED STATES PATENTS

| | | | |
|---|---|---|---|
| 3,424,578 | 1/1969 | Strnat et al. | 148/31.57 |
| 3,560,200 | 2/1971 | Nesbitt et al. | 148/31.57 |
| 3,682,716 | 8/1972 | Martin et al. | 148/31.57 |
| 3,790,414 | 2/1974 | Tawara et al. | 148/31.57 |

*Primary Examiner*—Walter R. Satterfield
*Attorney, Agent, or Firm*—Wenderoth, Lind & Ponack

[57] ABSTRACT

Rare earth cobalt magnet materials, which comprised of cobalt, manganese, copper and 12 to 13 mole % of cerium and/or samarium are provided. These magnetic materials have improved magnetic characteristics, especially very high values of the maximum energy product.

2 Claims, No Drawings

PERMANENT MAGNET MATERIALS

Background of the Invention

This invention relates to magnetic materials, and more particularly to magnetizable materials containing a rare earth and cobalt, which are referred to, for convenience, as rare earth cobalt magnet materials.

A rare earth cobalt magnet material can have a large coercive force when pulverized to fine powder. However, such fine powder is usually unstable in air and its magnetic properties are easily degraded in a short period. In order to obtain useful magnets made of rare earth cobalt materials, a number of techniques have been developed, among which the following are dominantly employed at present.

1. Fine powder of a rare earth cobalt material is compacted to a high density by means of mechanical compression.
2. The powder compact of (1) is further sintered.
3. A third element is added to a rare earth cobalt material which causes the bulk material to have a high coercive force. Cu is known to be the most effective of such elements.

Method (1) is most simple and direct in principle. However, in order to compact fine powder to near its theoretical density, a large apparatus is required, and it is usually difficult to accomplish in mass production. Moreover, the resultant product inevitably has open pores which causes degradation of magnetic properties over a long period of use at room and elevated temperatures.

These drawbacks are much improved by sintering such a compacted powder. In method (2), the densification is carried out not only by mechanical compaction but also sintering. Here, sintering conditions are carefully controlled so that no open pores are left in the sintered body while minimizing grain growth which may degrade coercive force. For this purpose, a "sintering aid" usually comprising rare earth rich rare earth cobalt alloys is mixed with a host $RCo_5$ alloy. The maximum energy product obtained with such a product well exceeds 20 MGOe which is the highest among all known permanent magnets. However, sintering conditions are very critical in order to meet the contradictory requirements, i.e. ultimate densification and minimal grain growth. For this reason, yields of products with optimum magnetic properties are usually poor.

The method (3) includes a proper heat treatment applied to a Cu containing rare earth cobalt composition so as to obtain ultra-fine precipitates in the host material. A high coercive force can be obtained by the aid of the fine precipitates which work as a "barrier" for domain wall motion. An initially claimed advantage of this method was that one can obtain a product by casting. However, such a cast material has poor homogeneity in both chemical composition and crystal alignment, which result in low and scattered magnetic properties within a product as well as among products. Also, because of brittleness which a rare earth cobalt material generally has, a cast material has cracks and microcracks in its body. This causes poor machinability for cutting or grinding.

Such drawbacks of the cast material can be markedly improved by a process including pulverizing a cast ingot into powder, compacting the powder and sintering the compacted powder. Thus, combining the Cu-containing compositions and the sintering method, one can obtain a homogeneous product with better machinability. A great merit of the combined method is that it is not necessary, as with other materials, to give special regard to the grain size control problem, which is often essential to obtain good magnetic properties. This permits facile production in that loose powder compaction is permitted and sintering conditions are not critical. However, this method has the disadvantage of reduced magnetic flux density due to dilution of the magnetic element, Co by the nonmagnetic element, Cu. Thus the limiting value of the maximum energy product obtainable by this method has been 10 to 12 MGOe, which is considerably lower than that obtained in the method (2).

Brief Summary of the Invention

Therefore, an object of the present invention is to provide improved rare earth cobalt magnet materials which are free from the drawbacks of the conventional materials described above.

The other object of the invention is to provide a novel composition which is suitable to produce a sintered magnet with unexpectedly high maximum energy product.

A further object of the invention is to provide an improved rare earth cobalt material which is easily formed into a useful magnet by a conventional sintering method.

These objects of the invention are achieved by providing the rare earth cobalt magnet materials according to the invention, which have a composition consisting of 1.2–11.05 mol% of Ce, 1.8–11.7 mol% of Sm, 60.9–77.44 mol% of Co, 2.175–10.56 mol% of Mn and 7.83–15.84 mol% of Cu.

Detailed Description of the Invention

Alloys of the invention can be prepared by several alternative methods. For example, Co, Mn, Cu and rare earth metals are weighed in a proper ratio and melted together under a protective atmosphere such as argon, by induction heating. Such alloys are pulverized by conventional means. The alloys are substantially nonreactive at room temperature, and therefore the pulverization can be carried out in air. More favorably, the alloys are pulverized in a protective atmosphere. For example, the alloys are crushed into a coarse grain in an iron mortar and coarse grains are successively pulverized into fine powder by a jet mill. A wide range of particle size of the powder can be used in the invention, and the most favorable particle size is 1 to 5 $\mu$. Although a larger particle size can be used, grain orientation of the final product is decreased with increasing the particle size of the raw powder.

The powder is compacted into a green tablet of desired shape and dimensions by any conventional means, such as a hydraulic pressing or a uniaxial pressing. It is favorable for the powder to be compacted in a magnetic field so that the easy axis of the grains are oriented to the field direction. Alternatively, the powder particles are magnetically oriented at first and then the powder is successively compacted. The better magnetic properties are provided when the grain orienting process is employed. The compacted body is sintered to complete densification. In the compacted body with a higher density, oxidation is caused to a smaller extent during rise of temperature in the sintering process. It is therefore favorable that the pressure of the compaction be as high as possible. However, a low density compaction can still be employed as well if the sintering process is executed in a high vacuum furnace. Also an oxygen free protective atmosphere such as high purity argon gas can be employed in the sintering process.

The sintering temperature should be varied according to the composition of the compacted body. The lowest sintering temperature adoptable in the invention should be high enough for each Co-Mn-Cu-R composition to be well sintered and densified. After sintering is completed, the sintered body is cooled to room temperature favorably in an inert atmosphere such as argon. An optimum sintering temperature is determined experimentaly, for example, by sintering several specimens of a composition at successively higher temperatures and measuring magnetic characteristics of each specimen. A sintering temperature between about 1000°C and about 1100°C is preferable for a composition of the invention.

When magnetized, the sintered body is useful as a permanent magnet. If necessary, the sintered magnet can be shaped by cutting and grinding to a desired shape. The permanent magnets of the invention have a wide variety of applications. For example, the magnet of the invention is useful for use in electric watches, phono-pick-ups, micromotors, microwave tubes, and others.

The features of the invention will be further illustrated by the following examples.

EXAMPLE 1

About 400 grams of a mixture of Co, Mn, Cu, Ce and Sm in a ratio given in the 1st column of the following table were melted in an alumina crucible in an argon atmosphere by induction heating. The melted alloy was cast in an iron mold into an ingot having a cylindrical shape of 30 mm in diameter. The ingot was crushed in an iron mortar into coarse grains and the coarse grains were pulverized into fine powder with average particle size of 1 $\mu$ by means of a nitrogen jet. The powder was mixed with toluene to form a pulp. About 15 grams of the pulped powder was put in a mold. An orienting magnetic field of about 10 KOe was applied to the pulped powder, and the powder was pressed into a soft cake. During pressing, the toluene was filtered off. The soft cake was aged at room temperature for a while until the most of the residual toluene evaporated off.

The soft cake was compacted into a green body in a rubber container by means of hydraulic pressing. The green body was sintered in an electric furnace in a vacuum of $10^{-5}$ mmHg. The sintering temperature and sintering time were selected so that the magnetic properties, particularly maximum energy product, were optimized.

The following table lists the best magnetic characteristics for each composition, and sintering conditions which were obtained.

Table

Compositions, sintering conditions and magnetic characteristics of the material of the invention.

| Sample No. | Composition (mol %) Co | Mn | Cu | Ce | Sm | Sintering condition temp. (°C) | time (hrs) | Residual flux density (G) | Coercive force (Oe) $I_H C$ | $B_H C$ | Maximum energy product (MGOe) |
|---|---|---|---|---|---|---|---|---|---|---|---|
| 1 | 67.01 | 5.15 | 15.46 | 10.52 | 1.86 | 1056 | 1.5 | 8000 | 4000 | 3700 | 13.0 |
| 2 | 67.01 | 5.15 | 15.46 | 9.91 | 2.47 | 1056 | 1.5 | 8000 | 4600 | 4100 | 13.0 |
| 3 | 67.01 | 5.15 | 15.46 | 7.42 | 4.96 | 1060 | 1.5 | 8500 | 5000 | 4200 | 14.2 |
| 4 | 67.01 | 5.15 | 15.46 | 6.19 | 6.19 | 1045 | 1.5 | 8700 | 6700 | 5800 | 17.0 |
| 5 | 67.01 | 5.15 | 15.46 | 3.71 | 8.67 | 1045 | 1.5 | 8900 | 7900 | 6850 | 18.1 |
| 6 | 67.01 | 5.15 | 15.46 | 2.46 | 9.92 | 1070 | 1 | 8400 | 7800 | 6000 | 15.5 |
| 7 | 67.01 | 5.15 | 15.46 | 1.23 | 11.15 | 1056 | 1.5 | 8000 | 6800 | 5900 | 14.0 |
| 8 | 66.67 | 5.13 | 15.38 | 6.41 | 6.41 | 1045 | 1 | 7100 | 10000 | 6200 | 11.5 |
| 9 | 71.79 | 5.13 | 10.26 | 6.41 | 6.41 | 1070 | 1.5 | 8650 | 7400 | 6800 | 17.5 |
| 10 | 71.79 | 5.13 | 10.26 | 5.13 | 7.69 | 1070 | 1 | 9000 | 7100 | 6600 | 19.2 |
| 11 | 74.36 | 5.13 | 7.69 | 5.13 | 7.69 | 1085 | 1 | 9200 | 2100 | 2000 | 10.1 |
| 12 | 74.36 | 2.56 | 10.26 | 5.13 | 7.69 | 1085 | 1 | 9250 | 7250 | 6400 | 18.3 |
| 13 | 67.18 | 5.17 | 15.50 | 3.63 | 8.52 | 1056 | 1.5 | 8350 | 4400 | 4200 | 14.5 |
| 14 | 67.70 | 5.21 | 15.63 | 6.87 | 4.59 | 1036 | 1 | 8300 | 3300 | 3100 | 11.7 |
| 15 | 71.79 | 5.13 | 10.26 | 3.85 | 8.97 | 1070 | 1 | 9100 | 6400 | 5900 | 19.9 |
| 16 | 71.79 | 5.13 | 10.26 | 2.57 | 10.25 | 1085 | 1 | 9000 | 4950 | 4600 | 18.9 |
| 17 | 67.01 | 5.15 | 15.46 | — | 12.38 | 1090 | 1 | 9000 | 2200 | 2000 | 9.4 |
| 18 | 67.01 | 5.15 | 15.46 | 12.38 | — | 1056 | 1 | 8000 | 2500 | 2100 | 8.7 |

It is apparent from the table that the maximum energy product of 10 to 20 MGOe can be obtained by the invention. These values are unexpectedly higher than those of known Cu-modified rare earth cobalt compositions. Further, it sould be noted that the coexistance of Ce and Sm in a proper ratio is meaningful for improvement of the magnetic characteristics. In particular the specimens No. 5, No. 10, No. 15 and No. 16 exhibit superior magnetic characteristics to those of the specimens No. 17 (Ce absent) and No. 18 (Sm absent).

EXAMPLE 2

The specimen No. 3 was aged at 150 °C for 100 hours and its magnetic characteristics were measured. There were no significant change of intrinsic coercive force, residual magnetic flux density and maximum energy product before and after the heat treatment. This shows that a product of the invention is highly stable to thermal aging below 150 °C.

EXAMPLE 3

A bar sample of 1 mm in diameter and 7 mm in length was cut out from the specimen No. 10. The bar sample was magnetized along its axis and mounted in a coil.

Its magnetic induction was measured at various temperatures by a conventional "sample pull-out" method. The temperature coefficient of the residual magnetic flux density thus determined was $\Delta Br/Br \cdot \Delta T \approx 0.05\%/°C$ in a temperature range between room temperature and 200 °C.

EXAMPLE 4

Two specimens 10-A and 10-B having the same composition as the specimen No. 10, were sintered for 1 hour at 1056 °C and at 1085 °C, respectively. Intrinsic coercive, residual magnetic flux density and maximum energy product were 7100 Oe, 8800 G and 18.7 MGOe, respectively for 10-A, and 6800 Oe, 9200 G and 18.8 MGOe, respectively for 10-B. This proves the fact that a deviation of at least ± 15 °C of the sintering temperature is allowed, and yet an optimum maximum energy product can be obtained.

In a different experiment, the specimen No. 10 was resintered at 1070 °C for 1 hour and the magnetic characteristics were measured. There were no significant change of characteristics before and after the secondary sintering. This proves the fact that sintering time is not critical at all for a material of the invention.

What we claim is:

1. A magnetic composition having a maximum energy product of above 12 MG·Oe comprising 12 to 13 mole % of at least one member selected from the group consisting of cerium and samarium, and the balance consisting essentially of cobalt, manganese and copper.

2. A magnetic composition as claimed in claim 1, wherein said magnetic composition consists essentially of 1.2 to 11.05 mole % of Ce, 1.8 to 11.7 mole % of Sm, 60.9 to 77.44 mole % of Co, 2.175 to 10.56 mole % of Mn and 7.83 to 15.84 mole % of Cu.

* * * * *